US011158228B1

(12) United States Patent
Wang et al.

(10) Patent No.: US 11,158,228 B1
(45) Date of Patent: Oct. 26, 2021

(54) DISPLAY DRIVING CIRCUIT AND DISPLAY DEVICE

(71) Applicant: SHENZHEN CHINA STAR OPTOELECTRONICS SEMICONDUCTOR DISPLAY TECHNOLOGY CO., LTD., Guangdong (CN)

(72) Inventors: Shanglong Wang, Guangdong (CN); Zhida Xu, Guangdong (CN); Ilgon Kim, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/968,423

(22) PCT Filed: May 9, 2020

(86) PCT No.: PCT/CN2020/089397

§ 371 (c)(1),
(2) Date: Aug. 7, 2020

(30) Foreign Application Priority Data

Apr. 20, 2020 (CN) ..... 202010312214.8

(51) Int. Cl.
*G09G 3/20* (2006.01)

(52) U.S. Cl.
CPC ..... *G09G 3/20* (2013.01); *G09G 2300/08* (2013.01); *G09G 2310/0267* (2013.01); *G09G 2310/0281* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 6,278,243 | B1 | 8/2001 | Yoo | |
| 2010/0085335 | A1 | 4/2010 | Kato | |
| 2019/0057656 | A1* | 2/2019 | Shi | G09G 3/3258 |
| 2019/0206293 | A1* | 7/2019 | Tian | G06F 3/0412 |
| 2021/0097917 | A1 | 4/2021 | Li | |

FOREIGN PATENT DOCUMENTS

| | | | | |
|---|---|---|---|---|
| CN | 101673526 | A | 3/2010 | |
| CN | 103295643 | A | 9/2013 | |
| CN | 107967888 | * | 4/2018 | G09G 3/20 |
| CN | 109559706 | A | 4/2019 | |
| CN | 109712582 | A | 5/2019 | |
| CN | 110675793 | A | 1/2020 | |

* cited by examiner

*Primary Examiner* — Ifedayo B Iluyomade
(74) *Attorney, Agent, or Firm* — The Roy Gross Law Firm, LLC; Roy Gross

(57) ABSTRACT

A display driving circuit and a display device are proposed. The display driving circuit includes a plurality of driving sets. Each of the plurality of driving sets is electrically connected to all scan lines of the display device. The scan lines are electrically connected to a display unit of the display device. Each of the plurality of driving sets controls a display function of the display device through the scan lines. Each of the plurality of driving sets is electrically connected to a triggering signal line, the triggering signal line is configured to control the plurality of driving sets to drive the display device in turn.

17 Claims, 3 Drawing Sheets

DISPLAY DRIVING CIRCUIT AND DISPLAY DEVICE

CROSS REFERENCE

This application claims the priority of Chinese Patent Application No. 202010312214.8, entitled "display driving circuit and display device", filed on Apr. 20, 2020, the disclosure of which is incorporated herein by reference in its entirety.

FIELD OF THE INVENTION

The present invention relates to a display technique, and more particularly, to a display driving circuit and a display device.

BACKGROUND

As the development of the tablet, high resolution, high contrast, high refresh frequency, narrow side frame, thinness become the demands of the display panel of the tablet. The GOA (gate driver on array) technique utilizes the current array substrate manufacturing process to implement the gate drivers on the array substrate such that the gate drivers could scan row by row of the display panel. This design is widely used because it could meet the demand of the narrow side frame.

The GOA circuit comprises multiple driving thin film transistors (TFTs) and switch TFTs. These TFTs' becomes unstable when they are working for a long time. This may ruin the performance of the display device.

Conventionally, when the display device is working for a long time, the GOA circuit is working for a long time as well. This makes the TFTs inside the GOA circuit unstable and thus may ruin the performance of the display device.

SUMMARY

One objective of an embodiment of the present invention is to provide a display driving circuit and a related display device to solve the above issue.

According to an embodiment of the present invention, a display driving circuit used in a display device is disclosed. The display driving circuit comprises: a plurality of driving sets, each of the plurality of driving sets being electrically connected to all scan lines of the display device, the scan line is electrically connected to a display unit of the display device, each of the plurality of driving sets controls a display function of the display device through the scan lines; wherein each of the plurality of driving sets is electrically connected to a triggering signal line, the triggering signal line is configured to control the plurality of driving sets to drive the display device in turn.

In the display driving circuit of the present disclosure, the plurality of driving sets comprise a first driving set and a second driving set, the first driving set is electrically connected to a first triggering signal line, the second driving set is electrically connected to a second triggering signal line, the first driving set and the second driving set drive the display device in turn.

In the display driving circuit of the present disclosure, the first driving set and the second driving set respectively comprise a plurality of stages of driving units, and a stage signal output end of each of the plurality of stages of driving units is electrically connected to one of the scan lines.

In the display driving circuit of the present disclosure, a stage signal output end of the first driving set is electrically connected to one of the scan lines through a first switch transistor, and a stage signal output end of the second driving set is electrically connected to one of the scan lines through a second switch transistor.

In the display driving circuit of the present disclosure, the first switch transistor is electrically connected to a first switch signal line, and the first switch signal line is configured to control an on/off state of the first switch transistor.

In the display driving circuit of the present disclosure, each stage of the driving units comprises: a pull-up control unit, electrically connected to a first clock signal input end, a first stage signal input end and a first node, configured to transfer a signal inputted into the first stage signal input end to the first node under a control of the first clock signal input end; and a pull-up unit, electrically connected to a first node, a second clock signal input end and a second node, configured to transfer a signal inputted into the second clock signal input end to the second node under a control of the first node. The second node is electrically connected to the stage signal output end.

In the display driving circuit of the present disclosure, each stage of the driving units further comprises:

a pull-down unit, electrically connected to the second node, a third node, and a second low voltage signal input end, configured to transfer a signal inputted to the second low voltage signal input end to the second node under a control of the third node; a pull-down control unit, electrically connected to the first node, a second stage signal input end and a first low voltage input end, configured to transfer a signal inputted to the first low voltage signal input end to the first node under a control of the second stage signal input end; and a pull-down maintaining unit, electrically connected to the first node, the third node, a high voltage signal input end and the first low voltage signal input end, configured to transfer a signal inputted to the first low voltage signal input end or the high voltage signal input end to the third node under a control of the first node.

In the display driving circuit of the present disclosure, the pull-up unit comprises a capacitor and a first transistor, a first end of the capacitor is electrically connected to the second clock signal input end, a second end of the capacitor is electrically connected to the first node, a gate of the first transistor is electrically connected to the first node, a source of the first transistor is electrically connected to the second clock signal input end, and a drain of the first transistor is electrically connected to the second node.

In the display driving circuit of the present disclosure, the pull-up control unit comprises a second transistor, a gate of the second transistor is electrically connected to the first clock signal input end, a source of the second transistor is electrically connected to the stage signal input end, and a drain of the second transistor is electrically connected to the first node.

In the display driving circuit of the present disclosure, the pull-down unit comprises a third transistor, having a gate electrically connected to the third node, a source electrically connected to the second low voltage signal input end, and a drain electrically connected to the second node.

In the display driving circuit of the present disclosure, the pull-down control unit comprises a fourth transistor, having a gate electrically connected to the second stage signal input end, a source electrically connected to the first low voltage signal input end, and a drain electrically connected to the first node.

In the display driving circuit of the present disclosure, the pull-down maintaining unit comprises a fifth transistor, a sixth transistor, and a seventh transistor. A source of the fifth transistor and a source of the sixth transistor are electrically connected to the first low voltage signal input end, a drain of the fifth transistor and a gate of the sixth transistor are electrically connected to the first node, a gate of the fifth transistor and a drain of the sixth transistor are electrically connected to the third node, a gate and a source of the seventh transistor are electrically connected to the high voltage signal input end, and a drain of the seventh transistor is electrically connected to the third node.

In the display driving circuit of the present disclosure, the first stage signal input end of a first stage of driving units in the first driving set is electrically connected to the first triggering signal line, and the first stage signal input end of a first stage of driving units in the second driving set is electrically connected to the second triggering signal line.

In the display driving circuit of the present disclosure, the first stage signal input end of a $n^{th}$ stage of driving units is electrically connected to the stage signal output end of a $(n-1)^{th}$ stage of driving units, and the second stage signal input end of the $n^{th}$ stage of driving units is electrically connected to the stage signal output end of a $(n+1)^{th}$ stage of driving units, wherein n is an integer larger than or equal to 2.

In the display driving circuit of the present disclosure, the first clock signal input end is electrically connected to a first clock signal line, the second clock signal input end is electrically connected to a second clock signal line, the first low voltage signal input end is electrically connected to a first low voltage signal line, the second low voltage signal input end is electrically connected to a second low voltage signal line, the high voltage signal line is electrically connected to a high voltage signal line.

According to an embodiment of the present invention, a display device is disclosed. The display device comprises the above-mentioned display driving circuit and displays an image through the display driving circuit.

According to an embodiment of the present invention, a display device is disclosed. The display device comprises a display region and a display driving circuit positioned on a side of the display region. The display driving circuit comprises a first driving set and a second driving set, the first driving set and the second driving set are respectively electrically connected to all scan lines of the display device, the scan line is electrically connected to a display unit of the display device, the first driving set and the second driving set respectively control a display function of the display device through the scan lines. The first driving set is electrically connected to a first triggering line, the second driving set is electrically connected to a second triggering line, and the first driving set and the second driving set drives the display device in turn.

In the display device of the present disclosure, the first driving set and the second driving set respectively comprise a plurality of stages of driving units, and a stage signal output end of each of the stages of driving units is electrically connected to one of the scan lines. A stage signal output end of the first driving set is electrically connected to one of the scan lines through a first switch transistor, and a stage signal output end of the second driving set is electrically connected to one of the scan lines through a second switch transistor.

In the display device of the present disclosure, the display driving circuit is positioned on a side edge of the display region.

In the display device of the present disclosure, the display driving circuit is positioned on two opposite side edges of the display region.

The display driving circuit and the display device comprises a plurality of driving sets. In the process of driving the display device, the driving sets works in turn and thus reduce the working time of a single driving set. This could raise the stability of the driving sets and performance of the display device.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 1:
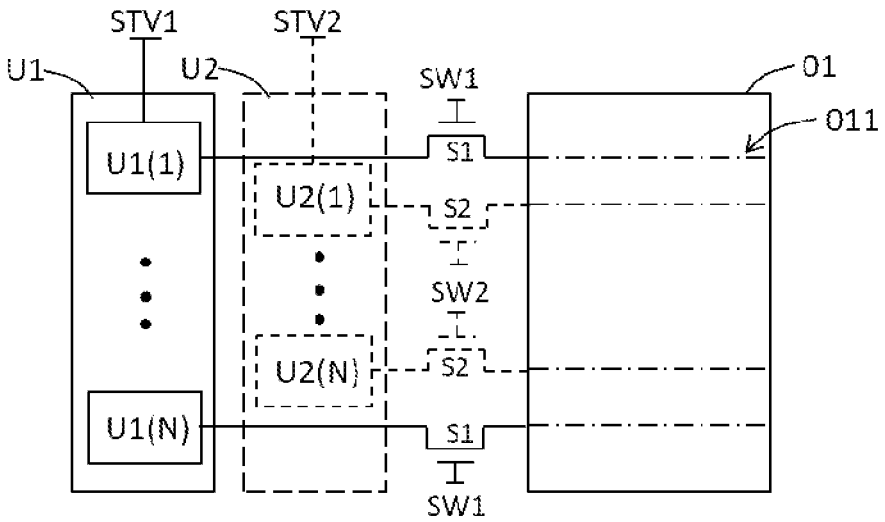
FIG. 1 is a diagram of a display driving circuit according to an embodiment of the present invention.

Please refer to FIG. 1. FIG. 1 is a diagram of a display driving circuit according to an embodiment of the present invention. The display driving circuit is used to drive the display device 01. The display driving circuit comprises a first driving set U1 and a second driving set U2. The display device comprises a plurality of scan lines 011. The scan lines 11 are electrically connected to the display units of the display device 01 for providing display driving signals to the display device 01.

The first driving set U1 comprises N stages of driving units, which are the first stage of driving units U1(1) to the $N^{th}$ stage of driving units U1(N). Here, the number N is an integer larger than or equal to 2. The second driving set U2 comprises N stages of driving units, which are the first stage of driving units U2(1) to the $N^{th}$ stage of driving units U2(N). Here, the number N is an integer larger than or equal to 2. The number of the stages in the first driving set U1 could be the same or different from the number the stages in the second driving set U2.

The stage signal output end of each stage of driving units in the first driving set U1 is electrically connected to one of the scan lines 011. The stage signal output ends of the first driving set U1 are electrically connected to all scan lines 011. The first driving set U1 could independently drive the display device 01 to display an image. The stage signal output end of each stage of driving units in the second driving set U2 is electrically connected to all scan lines 011. The stage signal output ends of the second driving set U2 are electrically connected to all scan lines 011. The second driving set U2 could independently drive the display device 01 to display an image.

The first driving set U1 is electrically connected to the first triggering signal line STV1. The second driving set U2 is electrically connected to the first triggering signal line STV2. The first stage of driving units U1(1) of the first driving set U1 is electrically connected to the first triggering line STV1 and the other stages of driving units are connected in cascade (as multiple stages). The first triggering signal line STV1 is used to send the triggering signal to the first driving set U1. The second stage of driving units U2(1) of the second driving set U2 is electrically connected to the first triggering line STV1 and the other stages of driving units are connected in cascade (as multiple stages). The second triggering signal line STV2 is used to send the triggering signal to the second driving set U2. The first triggering signal line STV1 and the second triggering signal line STV2 control the first driving set U1 and the second driving set U2 to make them work in turn such that the working period of the first driving set U1 and the second driving set U2 could be reduced and the performance of the display device could be raised.

The stage signal output ends of the first driving set U1 are electrically connected to the scan lines 011 through the first switch transistors S1. The first switch transistor S1 is electrically connected to the first switch signal line SW1. The first switch signal line SW1 is used to control the on/off state of the first switch transistor S1. The stage signal output ends of the second driving set U2 are electrically connected to the scan lines 011 through the second switch transistors S2. The second switch transistor S2 is electrically connected to the second switch signal line SW2. The second switch signal line SW2 is used to control the on/off state of the second switch transistor S2.

Figure 2:
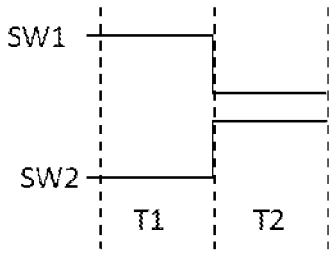
FIG. 2 is a timing diagram of a first switch signal line SW1 and a second switch signal line SW2.

Please refer to FIG. 1 and FIG. 2. FIG. 2 is a timing diagram of a first switch signal line SW1 and a second switch signal line SW2. In the first time period T1, the second driving set U2 does not work but the first triggering signal line STV1 triggers the first driving set U1 to work. In the second time period T2, the first driving set U1 does not work but the second triggering signal line STV2 triggers the second driving set U2 to work. In the first time period T1, the first switch signal line SW1 controls the first switch transistor S1 to turn on such that the first driving set U1 drives the display device 01 to display an image. At this time, the second switch signal line SW2 controls the second switch transistor S2 to turn off and the second driving set U2 does not work. In the second time period T2, the second switch signal line SW2 controls the second switch transistor S2 to turn on such that the second driving set U2 drives the display device 01 to display an image. At this time, the first switch signal line SW1 controls the first switch transistor S1 to turn off and the first driving set U1 does not work. According to the above operations, the first driving set U1 and the second driving set U2 drives the display 01 in turn. Thus, the working time for one single driving set is reduced, the risk for the driving sets to abnormally is reduced, and thus the performance of the display device could be raised.

In this embodiment, the structure of the driving unit in the first driving set U1 and the structure of the driving unit in the second driving set U2 could be the same or different. In the following disclosure, the first driving set U1 is taken as an example to illustrate the structure of the driving unit and stage-to-stage relationship of the driving units in the first driving set U1.

Figure 3:
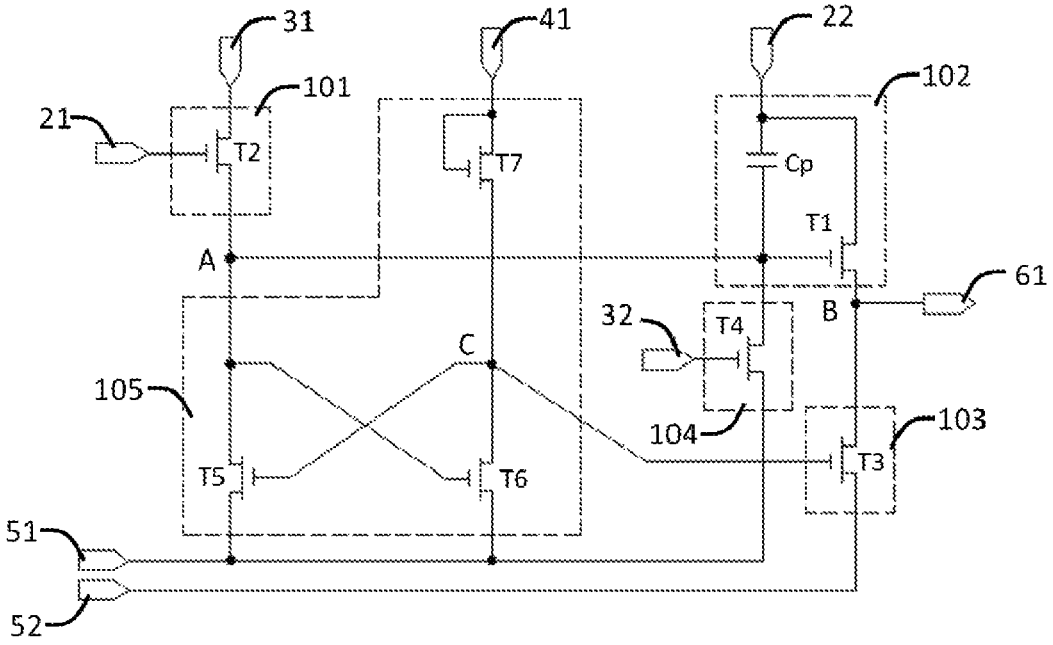
FIG. 3 is a diagram of a circuit structure of a driving unit in the display driving circuit according to an embodiment of the present invention.

Please refer to FIG. 3. FIG. 3 is a diagram of a circuit structure of a driving unit in the display driving circuit according to an embodiment of the present invention. As shown in FIG. 3, the driving unit comprises a pull-up control unit 101, a pull-up unit 102, a pull-down unit 103, a pull-down control unit 104 and a pull-down maintaining unit 105.

The pull-up control unit 101 is electrically connected to a first clock signal input end 21, a first stage signal input end 31 and a first node A. The pull-up control unit 101 is used to the signal inputted into the first stage signal input end 21 to the first node A under the control of the first clock signal input end 21.

The pull-up control unit 101 comprises a second transistor T2. The gate of the second transistor T2 is electrically connected to the first clock signal input end 21. The source of the second transistor T2 is electrically connected to the stage signal input end 31. The drain of the second transistor T2 is electrically connected to the first node A.

In this embodiment, the transistors in the display driving circuit could be implemented as n-type transistors or p-type transistors. In the following embodiments, n-type transistors are used as an example to illustrate. It should be understood that when a high voltage is applied to the gate of the n-type transistor, the source and the drain are conductive and the n-type transistor is turned on. Otherwise, the n-type transistor is turned off. In contrast, when a low voltage is applied to the gate of the p-type transistor, the source and the drain are conductive and the p-type transistor is turned on. Otherwise, the p-type transistor is turned off.

The pull-up unit 102 electrically connected to a first node A, a second clock signal input end 22 and a second node B. The pull-up unit 102 is used to transfer the signal inputted into the second clock signal input end 22 to the second node B under the control of the first node A.

The pull-up unit 102 comprises a capacitor Cp and a first transistor T1. The first end of the capacitor Cp is electrically connected to the second clock signal input end 22 and the second end of the capacitor Cp is electrically connected to the first node A. The gate of the first transistor T1 is electrically connected to the first node A. The source of the first transistor T1 is electrically connected to the second clock signal input end 22. The drain of the first transistor T1 is electrically connected to the second node B.

The second node B is electrically connected to the stage signal output end 61. The stage signal output end 61 are electrically connected to the scan lines 011 of the display device 01 (as shown in FIG. 1) and are used to provide driving signals to the display units of the display device 01.

The two ends of the capacitor Cp are respectively connected to the second clock signal input end 22 and the first node A. The stage signal output end 61 is connected to the capacitor Cp through the first transistor T1 in parallel. Therefore, the second clock signal input end 22 can be transferred to the stage signal output end 61 through the first transistor T1 without any consumption due to the capacitor Cp. This could ensure that the signal outputted from the stage signal output end 61 has an enough strength and stability.

The pull-down unit 103 is electrically connected to the second node B, a third node C, and a second low voltage signal input end 52. The pull-down unit 103 is used to transfer the signal inputted to the second low voltage signal input end 52 to the second node B under the control of the third node C. in this way, the voltage level of the second node B could be pulled down such that the stage signal output end could output a low voltage level.

The pull-down unit 103 comprises a third transistor T3, having the gate electrically connected to the third node C, the source electrically connected to the second low voltage signal input end 52, and the drain electrically connected to the second node B.

The pull-down control unit 104 is electrically connected to the first node A, a second stage signal input end 32 and a first low voltage input end 51. The pull-down control unit 104 is used to transfer the signal inputted to the first low voltage signal input end 51 to the first node A under the control of the second stage signal input end 32 such that the voltage level of the first node A could be pulled down.

The pull-down control unit 104 comprises a fourth transistor T4, having the gate electrically connected to the second stage signal input end 32, the source electrically connected to the first low voltage signal input end 51, and the drain electrically connected to the first node A.

The pull-down maintaining unit 105 is electrically connected to the first node A, the third node C, a high voltage signal input end 41 and the first low voltage signal input end 51. The pull-down maintaining unit 105 is used to transfer the signal inputted to the first low voltage signal input end 51 or the high voltage signal input end 41 to the third node C under the control of the first node A such that the voltage level of the third node C could be pulled up or pulled down.

The pull-down maintaining unit 105 comprises a fifth transistor T5, a sixth transistor T6, and a seventh transistor T7. The source of the fifth transistor T5 and the source of the sixth transistor T6 are electrically connected to the first low voltage signal input end 51. The drain of the fifth transistor T5 and the gate of the sixth transistor T6 are electrically connected to the first node A. The gate of the fifth transistor T5 and the drain of the sixth transistor T6 are electrically connected to the third node C. The gate and the source of the seventh transistor T7 are electrically connected to the high voltage signal input end 41, and the drain of the seventh transistor T7 is electrically connected to the third node C.

The first low voltage signal input end 51 pulls down the voltage level of the first node A. The second low voltage signal input end 52 pulls down the voltage level of the second node B. In this way, it could ensure that the stage signal output end 61 could be maintained in a low voltage condition when there is no high voltage signal outputting. This could prevent the signal outputted from the stage signal output end from being abnormal due to the variation of the voltage level of the second node B.

In the following disclosure, the stage-to-stage relationship of the driving units in the first driving set U1 will be illustrated.

Figure 4:
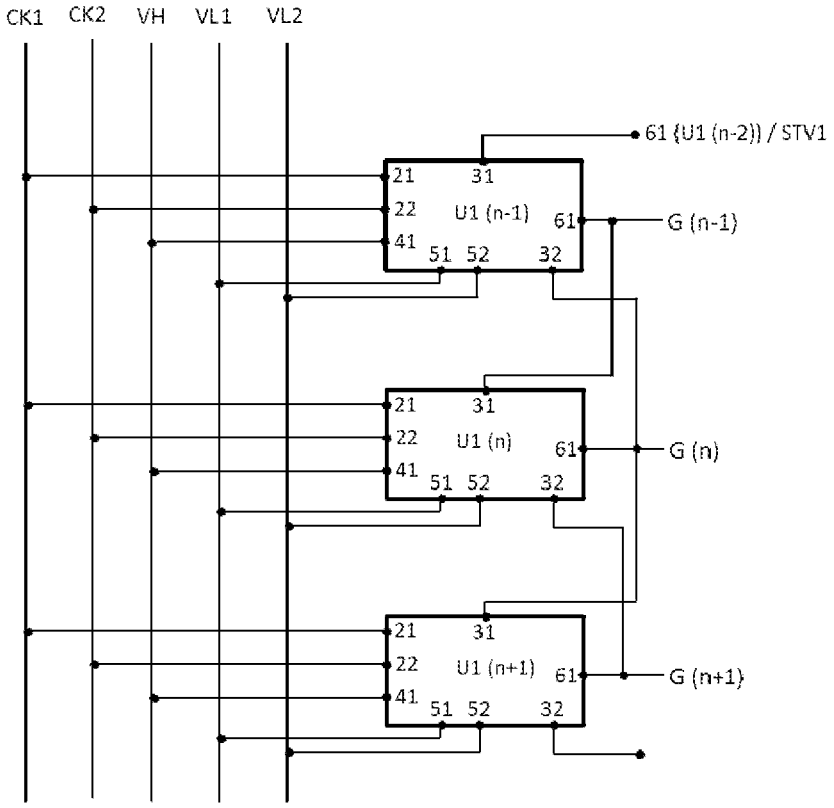
FIG. 4 is a diagram showing the stage-to-stage connection in the first driving set in the display driving circuit according to an embodiment of the present invention.

Please refer to FIG. 4. FIG. 4 is a diagram showing the stage-to-stage connection in the first driving set in the display driving circuit according to an embodiment of the present invention. As shown in FIG. 4, the first stage signal input end 31 of the $n^{th}$ stage of driving units U1($n$) is electrically connected to the stage signal output end 61 of the $(n-1)^{th}$ stage of driving units U1($n$−1). The second stage signal input end 32 of the $n^{th}$ stage of driving units U1($n$) is electrically connected to the stage signal output end 61 of a $(n+1)^{th}$ stage of driving units U1($n$+1). Here, the number n is an integer larger than or equal to 2.

Specifically, please refer to FIG. 1 and FIG. 4. When n=2, the first stage signal input end 31 of the first stage of driving units U1(1) is electrically connected to the first triggering signal line STV1.

For a stage of driving units, the connection relationship of the stage of driving units is as follows: The first clock signal input end 21 is electrically connected to a first clock signal line CK1. The first clock signal line CK1 is used to transfer the first clock signal to the first clock signal input end 21. The second clock signal input end 22 is electrically connected to a second clock signal line CK2. The second clock signal line CK2 is used to transfer the second clock signal to the second clock signal input end 22. The first low voltage signal input end 51 is electrically connected to a first low voltage signal line VL1. The first low voltage signal line VL1 is used to transfer the first low voltage signal to the first low voltage signal input end 51. The second low voltage signal input end 52 is electrically connected to a second low voltage signal line VL2. The second low voltage signal line VL2 is used to transfer the second low voltage signal to the second low voltage signal input end 52. The high voltage signal line 41 is electrically connected to a high voltage signal line VH. The high voltage signal line VH is used to transfer the high voltage signal to the high voltage signal line 41.

The stage signal output end 61 outputs the stage signal G. The stage signal G could be used to drive the display device to display an image.

Figure 5:
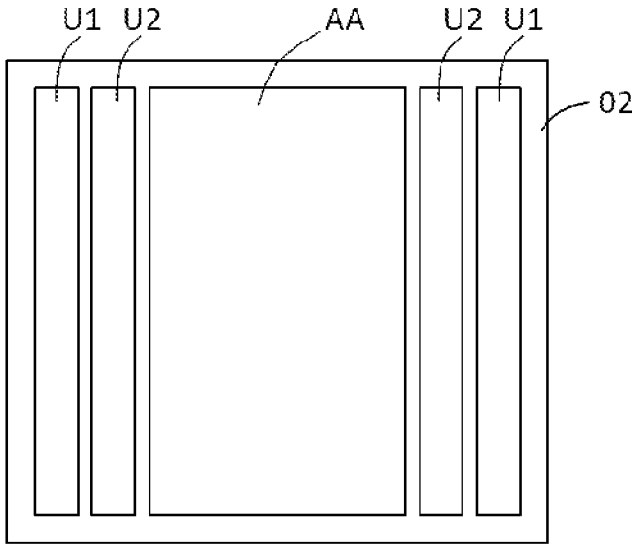
FIG. 5 is a diagram of a display device according to an embodiment of the present invention.

Please refer to FIG. 5. FIG. 5 is a diagram of a display device according to an embodiment of the present invention. As shown in FIG. 5, a display device 02 is provided. The display device 02 comprises the above-mentioned display driving circuit. The display device 02 displays an image through the display driving circuit. The display device 02 comprises a display region AA. The first driving set U1 and the second driving set U2 of the display driving circuit are positioned in parallel on a side of the display region AA. Each of the first driving set U1 and the second driving set U2 could independently drive the display device 02 to display an image. Therefore, the first driving set U1 and the second driving set U2 could work in turn when the display device performs the display function.

Or, the display driving circuit could be positioned on opposite sides of the display region AA. That is, one of the first driving set U1 and the second driving set U2 could be positioned on one side of the display region AA and the other of the first driving set U1 and the second driving set U2 could be positioned on the opposite side of the display region AA. In this way, the display driving circuit could drive the display region AA from its two sides. This could further raise the driving efficiency and the driving ability of the display driving circuit.

Above are embodiments of the present invention, which does not limit the scope of the present invention. Any modifications, equivalent replacements or improvements within the spirit and principles of the embodiment described above should be covered by the protected scope of the invention.

What is claimed is:

1. A display driving circuit used in a display device, the display driving circuit comprising:

a plurality of driving sets, each of the plurality of driving sets being electrically connected to all scan lines of the display device, the scan lines are electrically connected to a display unit of the display device, each of the plurality of driving sets controls a display function of the display device through the scan lines;

wherein each of the plurality of driving sets is electrically connected to a triggering signal line, the triggering signal line is configured to control the plurality of driving sets to drive the display device in turn;

wherein the first driving set and the second driving set respectively comprise a plurality of stages of driving units, and a stage signal output end of each of the plurality of stages of driving units is electrically connected to one of the scan lines, and each stage of the driving units comprises:

a pull-up control unit, electrically connected to a first clock signal input end, a first stage signal input end and a first node, configured to transfer a signal inputted into the first stage signal input end to the first node under a control of the first clock signal input end;

a pull-up unit, electrically connected to a first node, a second clock signal input end and a second node, configured to transfer a signal inputted into the second clock signal input end to the second node under a control of the first node;

a pull-down unit, electrically connected to the second node, a third node, and a second low voltage signal input end, configured to transfer a signal inputted to the second low voltage signal input end to the second node under a control of the third node;

a pull-down control unit, electrically connected to the first node, a second stage signal input end and a first low voltage input end, configured to transfer a signal inputted to the first low voltage signal input end to the first node under a control of the second stage signal input end; and a pull-down maintaining unit, electrically connected to the first node, the third node, a high voltage signal input end and the first low voltage signal input end, configured to transfer a signal inputted to the first low voltage signal input end or the high voltage signal input end to the third node under a control of the first node;

wherein the second node is electrically connected to the stage signal output end.

2. The display driving circuit of claim 1, wherein the plurality of driving sets comprise a first driving set and a second driving set, the first driving set is electrically connected to a first triggering signal line, the second driving set is electrically connected to a second triggering signal line, the first driving set and the second driving set drive the display device in turn.

3. The display driving circuit of claim 1, wherein a stage signal output end of the first driving set is electrically connected to one of the scan lines through a first switch transistor, and a stage signal output end of the second driving set is electrically connected to one of the scan lines through a second switch transistor.

4. The display driving circuit of claim 3, wherein the first switch transistor is electrically connected to a first switch signal line, and the first switch signal line is configured to control an on/off state of the first switch transistor.

5. The display driving circuit of claim 1, wherein the pull-up unit comprises a capacitor and a first transistor, a first end of the capacitor is electrically connected to the second clock signal input end, a second end of the capacitor is electrically connected to the first node, a gate of the first transistor is electrically connected to the first node, a source of the first transistor is electrically connected to the second clock signal input end, and a drain of the first transistor is electrically connected to the second node.

6. The display driving circuit of claim 1, wherein the pull-up control unit comprises a second transistor, a gate of the second transistor is electrically connected to the first clock signal input end, a source of the second transistor is electrically connected to the stage signal input end, and a drain of the second transistor is electrically connected to the first node.

7. The display driving circuit of claim 1, wherein the pull-down unit comprises a third transistor, having a gate electrically connected to the third node, a source electrically connected to the second low voltage signal input end, and a drain electrically connected to the second node.

8. The display driving circuit of claim 1, wherein the pull-down control unit comprises a fourth transistor, having a gate electrically connected to the second stage signal input end, a source electrically connected to the first low voltage signal input end, and a drain electrically connected to the first node.

9. The display driving circuit of claim 1, wherein the pull-down maintaining unit comprises a fifth transistor, a sixth transistor, and a seventh transistor;

wherein a source of the fifth transistor and a source of the sixth transistor are electrically connected to the first low voltage signal input end, a drain of the fifth transistor and a gate of the sixth transistor are electrically connected to the first node, a gate of the fifth transistor and a drain of the sixth transistor are electrically connected to the third node, a gate and a source of the seventh transistor are electrically connected to the high voltage signal input end, and a drain of the seventh transistor is electrically connected to the third node.

10. The display driving circuit of claim 1, wherein the first stage signal input end of a first stage of driving units in the first driving set is electrically connected to the first triggering signal line, and the first stage signal input end of a first stage of driving units in the second driving set is electrically connected to the second triggering signal line.

11. The display driving circuit of claim 1, wherein the first stage signal input end of a $n^{th}$ stage of driving units is electrically connected to the stage signal output end of a $(n-1)^{th}$ stage of driving units, and the second stage signal input end of the $n^{th}$ stage of driving units is electrically connected to the stage signal output end of a $(n+1)^{th}$ stage of driving units, wherein n is an integer larger than or equal to 2.

12. The display driving circuit of claim 1, wherein the first clock signal input end is electrically connected to a first clock signal line, the second clock signal input end is electrically connected to a second clock signal line, the first low voltage signal input end is electrically connected to a first low voltage signal line, the second low voltage signal input end is electrically connected to a second low voltage signal line, the high voltage signal line is electrically connected to a high voltage signal line.

13. A display device, comprising a display driving circuit of claim 1, wherein the display device displays an image through the display driving circuit.

14. A display device, comprising a display region, and a display driving circuit positioned on a side of the display region;

wherein the display driving circuit comprises a first driving set and a second driving set, the first driving set and the second driving set are respectively electrically connected to all scan lines of the display device, the scan lines are electrically connected to a display unit of the display device, the first driving set and the second driving set respectively control a display function of the display device through the scan lines; and wherein the first driving set is electrically connected to a first triggering line, the second driving set is electrically connected to a second triggering line, and the first driving set and the second driving set drive the display device in turn;

wherein the first driving set and the second driving set respectively comprise a plurality of stages of driving units, and a stage signal output end of each of the plurality of stages of driving units is electrically connected to one of the scan lines, and each stage of the driving units comprises:

a pull-up control unit, electrically connected to a first clock signal input end, a first stage signal input end and a first node, configured to transfer a signal inputted into the first stage signal input end to the first node under a control of the first clock signal input end;

a pull-up unit, electrically connected to a first node, a second clock signal input end and a second node, configured to transfer a signal inputted into the second clock signal input end to the second node under a control of the first node;

a pull-down unit, electrically connected to the second node, a third node, and a second low voltage signal input end, configured to transfer a signal inputted to the second low voltage signal input end to the second node under a control of the third node;

a pull-down control unit, electrically connected to the first node, a second stage signal input end and a first low voltage input end, configured to transfer a signal inputted to the first low voltage signal input end to the first node under a control of the second stage signal input end; and a pull-down maintaining unit, electrically connected to the first node, the third node, a high voltage signal input end and the first low voltage signal input end, configured to transfer a signal inputted to the first low voltage signal input end or the high voltage signal input end to the third node under a control of the first node;

wherein the second node is electrically connected to the stage signal output end.

15. The display device of claim 14, wherein the first driving set and the second driving set respectively comprise a plurality of stages of driving units, and a stage signal output end of each of the stages of driving units is electrically connected to one of the scan lines;

wherein a stage signal output end of the first driving set is electrically connected to one of the scan lines through a first switch transistor, and a stage signal output end of the second driving set is electrically connected to one of the scan lines through a second switch transistor.

16. The display device of claim 14, wherein the display driving circuit is positioned on a side edge of the display region.

17. The display device of claim 14, wherein the display driving circuit is positioned on two opposite side edges of the display region.

* * * * *